United States Patent [19]

Hartl

[11] 4,144,471

[45] Mar. 13, 1979

[54] ROTATING ANODE X-RAY TUBE

[75] Inventor: Walter Hartl, Hamburg, Fed. Rep. of Germany

[73] Assignee: U.S. Philips Corporation, New York, N.Y.

[21] Appl. No.: 863,932

[22] Filed: Dec. 23, 1977

[30] Foreign Application Priority Data

Dec. 23, 1976 [DE] Fed. Rep. of Germany ..... 2658513

[51] Int. Cl.[2] ..... H01J 35/10

[52] U.S. Cl. ..... 313/60; 313/40

[58] Field of Search ..... 313/60

[56] References Cited

U.S. PATENT DOCUMENTS 3,790,836 2/1974 Braun ..... 313/60 X

*Primary Examiner*—Palmer C. Demeo
*Assistant Examiner*—Darwin R. Hostetter
*Attorney, Agent, or Firm*—Algy Tamoshunas

[57] ABSTRACT

The invention relates to a rotating-anode X-ray tube with increased continuous loadability. The anode comprises a plurality of concentrically disposed hollow cylindrical bodies, which are connected to each other at their end faces in such a way that a meander-shaped cross-section is obtained. The thermal resistance is then very high, while the radiant cooling is very good because of the large surface area. The energy which is radiated towards the interior can be absorbed by hollow cylindrical cooling surfaces which are connected to the tube envelope.

9 Claims, 1 Drawing Figure

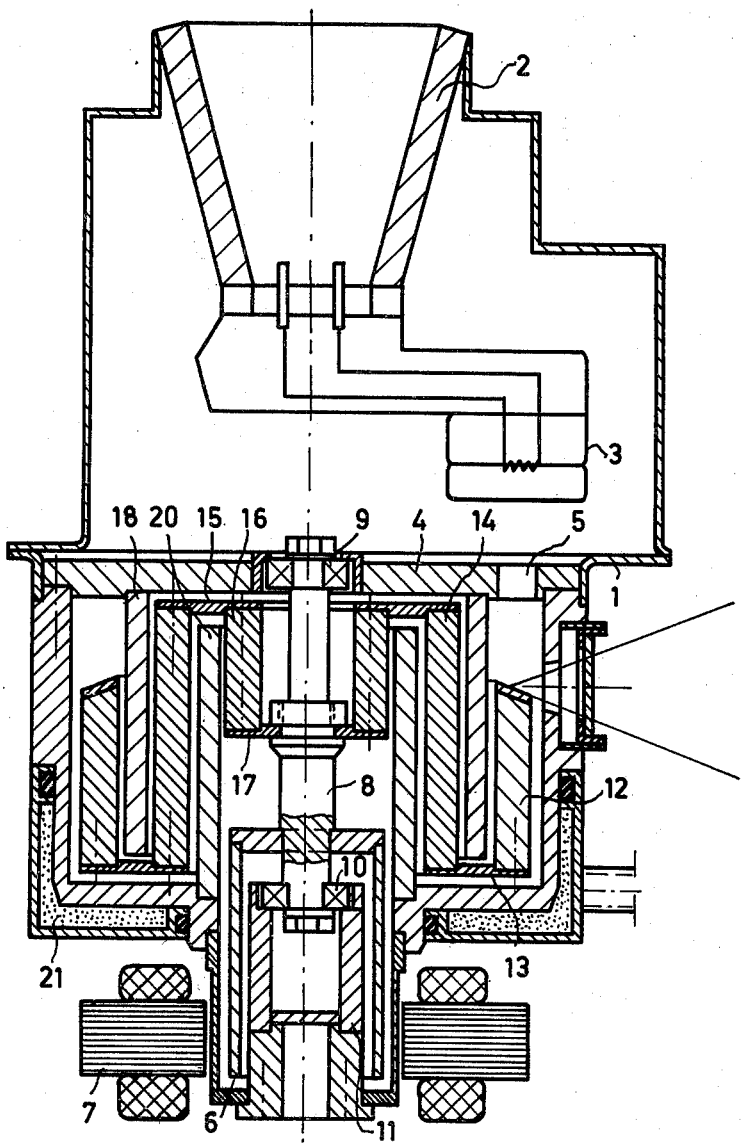
2
3
18
20
15
16
9
4
14
5
1
17
8
12
10
21
13
7
6
11

ROTATING ANODE X-RAY TUBE

The invention relates to a rotating anode X-ray tube comprising a rotor for driving a spindle carrying a rotationally-symmetrical anode body which is coaxial with the spindle. Nearly all X-ray tubes which are now in practical use are constructed in accordance with this principle. The anode body then takes the form of a disc with a central bore for the spindle, which is rigidly connected to the anode body.

Rotating anode X-ray tubes can briefly handle a load which is substantially higher than in the case of stationary anode X-ray tubes - owing to the rotating-anode principle. However, in the case of X-ray examinations which last substantially longer than a few seconds, stationary anode X-ray tubes may be subjected to a higher load (a few kilowatts), because stationary-anode X-ray tubes can easily be cooled with a cooling liquid whereas rotating anode X-ray tubes generally can be cooled only by radiation of energy which is converted into heat in the anode disc. However, stationary anode X-ray tubes capable of operation with such continuous loads have a very large focal spot (a few millimeters), which gives rise to substantial geometric distortion. Therefore, tubes with such a focal spot cannot be used for X-ray examinations requiring reproduction of smaller details.

Several attempts have been made to improve the continuous loadability of rotating anode X-ray tubes. These attempts are directed at increasing the thermal emissivity of the anode body, for example by the use of graphite as the basic anode body and at improving the emission by a suitable design, and as well as a combination of these (compare for example Belgian Pat. No. 737 628).

In Austrian Pat. No. 139 558 a rotating-anode X-ray tube is described, in which the anode body consists of a disc which on its side which is remote from the focal-spot path is connected to cylindrical surfaces which are coaxial with each other and which are concentric with the stationary spindle around which the anode body rotates by means of a bearing which is mounted in the disc. These surfaces also serve as rotor and should therefore produce only a minimal radiation in the space outside the X-ray tube, so as to prevent the stator from being heated excessively. Therefore, the anode body is clad with a highly reflecting metal and highly polished at this location, resulting in a high reflectivity or a low emissivity. The cylindrical surfaces of the anode disc then radiate the energy towards the inside onto cooling surfaces which are also cylindrical and coaxially arranged inside the cylindrical surfaces, which cooling surfaces form part of a cooling body which also comprises the spindle around which the anode body is rotated.

In this X-ray tube the bearing which carries the anode disc is heated substantially, so that the anode disc would already become stuck after a very short period of operation. Moreover, the spindle on which the bearing is mounted is additionally heated via the cooling surfaces. Therefore, such X-ray tubes were found to be impracticable.

It is an object of the present invention to provide a rotating-anode X-ray tube with an increased continuous loadability. For this it is essential that the spindle which carries the anode body and the bearings in which the spindle is journalled are not impermissibly heated.

Starting from a rotating-anode X-ray tube of the type mentioned in the preamble this object is achieved in that the body is a hollow body, whose one end face constitutes the focal-spot path and whose other end face is connected to the spindle. The hollow body then radiates most of the thermal energy applied to the end face with the focal-spot path to the exterior. The thermal resistance between the focal-spot path and the spindle is then comparatively high, because the heat flow should first pass through the anode body and then through the part which connects the anode body to the spindle.

In accordance with a further embodiment of the invention the thermal resistance can be increased further in that in the interior of the anode body there is located at least one further rotation-symmetrical hollow body which is concentric with the spindle, that the one end face of the inner hollow body is connected to the spindle, that one end face of the outer hollow body is connected to the other end face of the anode body, and that each time one end face of a hollow body is connected to the corresponding end face of an adjacent hollow body, in such a way that a meander-like cross-section is obtained in a plane which contains the axis of rotation. If there is provided only one hollow body, its one end face is connected to the other end face of the anode body and its other end face to the spindle.

In a further embodiment of the invention the anode body, and, as the case may be, the hollow body are hollow cylindrical bodies. In principle, the anode body or the hollow body may also have a different shape, for example the shape of a hollow truncated cone. It is essential only that the hollow body–except at the location of the other end face–has an inner diameter which is substantially greater than the outer diameter of the spindle, and that the wall thickness of the hollow body is substantially smaller than its dimension in the direction of the axis of rotation. However, a hollow cylindrical body can be manufactured most simply.

In a further embodiment of the invention, which may be used in rotating anode X-ray tubes comprising an at least partly metal tube envelope, there is provided in the interior of the anode body or of a hollow body respectively at least one cooling surface which surrounds the adjacent hollow body or the spindle, which cooling surface is connected to the metal parts of the tube envelope for good thermal conduction.

As a result of this the thermal energy which is radiated towards the interior onto the spindle or the hollow bodies which are disposed further inwards by the anode body or the hollow body in its interior is carried off by the cooling surfaces via the metal parts of the tube envelope, which can be cooled in a satisfactory manner without any further problems. As a result of this, the temperature of the spindle or the bearings carrying the spindle can be reduced still further.

The invention will now be described in more detail with reference to the drawing which shows an embodiment.

The drawing shows an X-ray tube comprising a tubular metal envelope 1 with grounded anode and a cathode/[3]which carries a negative high voltage. The cathode 3 is connected to the metal envelope 1 via a ceramic insulator 2. The cathode space is electrically screened from the anode space by a comparatively thick plate 4. At the location of the cathode, the plate 4 has a bore 5 for passage of electrons emitted by the cathode.

The rotating anode comprises a rotor 6 driven in known manner by a stator 7 which is disposed outside the tube envelope and which is rigidly connected to a spindle or shaft 8. One end of the spindle 8 is journalled in a bearing 9, which is mounted in the plate 4, and the other end is journalled in a bearing 10 mounted in a metal member 11 which is rigidly connected to the tube envelope 1 and which projects into the rotor 6. Since the spindle 8 is journalled at two ends, this construction ensures a particularly smooth rotation and stable journalling.

The anode body is formed by a hollow cylinder 12, made of a material with a high thermal emissivity, for example graphite. The end face of cylinder 12 adjacent the cathode 3 is clad with tungsten or a tungsten alloy and is bevelled, so that the end face makes an acute angle with the inner surface of the anode cylinder and the effective radiation beam can emerge from the X-ray tube perpendicularly to the axis of rotation.

The other end face of the anode body is connected via an annular disc 13 to the end face of a hollow cylinder 14, also consisting of graphite, which is disposed in the interior of the anode body coaxially with the axis of rotation. The other end face of cylinder 14 is connected via a further annular disc 15 to the end face of a further hollow cylinder 16, also consisting of graphite, which is disposed in the interior of the hollow cylinder 14 coaxially with the axis of rotation. The other end face of cylinder 16 is secured to the spindle 8 via an annular disc 17.

The annular discs 13, 15 and 17 consist of a heat-proof material, for example molybdenum, and are not thicker than necessary for mechanical stability, so as to maximize thermal resistance. Suitably, the annular discs 13, 15, 17 are connected to the hollow bodies 14 and 16 and the anode body respectively by means of a pressed joint, so that a higher heat transfer resistance is obtained.

The heat which is radiated towards the interior by the anode body 12 and towards the exterior by the hollow cylinder 14 is for the most part absorbed by a cooling cylinder 18, which is secured to the plate 4 and projects into the intermediate space between the anode body and the hollow cylinder 14 closely approaching the annular disc 13. The cooling cylinder 18 consists of a material with good thermal conductivity, for example, copper, and its surface is blackened and roughened, so as to ensure a satisfactory absorption of thermal radiation. The cooling cylinder 18 is connected to the plate 4 for good thermal conduction and plate 4 in turn is in good thermal contact with the tube envelope 1. In order to absorb the radiation emitted towards the interior by the hollow cylinder 14 and towards the exterior by the hollow cylinder 16 there is provided a further cooling cylinder 20 which has similar properties as the cooling cylinder 18 and which projects into the intermediate space between the hollow cylinder 14 and the hollow cylinder 16 closely approaching the annular disc 15. This cooling cylinder is connected to the lower housing bottom. The thermal energy transferred to the part of the tube envelope on the anode side by direct thermal radiation or via the cooling cylinders 18 and 20 is carried off by circulation type cooling means 21, shown schematically, which directly cools a part of the tube envelope.

Owing to the high thermal resistance between the focal-spot path and the spindle and the removal of the inwardly radiated thermal energy via the tube envelope, it is ensured that the temperature of the bearings 9 and 10 remains below the permissible value when the focal-spot path is subjected to a substantial continuous load. A similar continuous loadability could be achieved by the use of a single correspondingly long anode body, but a far more compact construction is obtained by the use of a plurality of coaxially arranged hollow cylinders of different diameter, whose end faces are connected in a manner as shown in the drawing, so as to obtain a meander-like cross-section of the anode body and the hollow cylinders together with the annular discs.

What is claimed is:

1. An x-ray tube comprising an envelope, a shaft mounted for rotation in said envelope, an elongated anode body having a central hole extending longitudinally therethrough, said anode body being disposed coaxially about and spaced from said shaft to define with said shaft an annular space therebetween extending from one end of said body substantially along the entire length of said body, a cathode mounted in said envelope and arranged to direct a beam of electrons onto said one end of said anode body and means for connecting the end of said body remote from said cathode to said shaft to thereby reduce the conduction of heat from said one end of said body to said shaft.

2. An x-ray tube according to claim 1 including a cylindrical member coaxial with said shaft interposed between said shaft and said anode body.

3. An x-ray tube according to claim 2 wherein said connecting means includes a first plate secured to said end of said body remote from said cathode and the adjacent end of said member and a second plate secured to the other end of said member and connected to said shaft.

4. An x-ray tube according to claim 3 including means interposed between said shaft and said anode body for absorbing heat radiated by said anode body.

5. An x-ray tube according to claim 4 wherein at least a portion of said envelope is made of metal and said absorbing means includes a second cylindrical member coaxial with said shaft interposed between said anode body and said first-named member and connected to said metal portion of said envelope.

6. An x-ray tube accordin to claim 3 including a further cylindrical member coaxial with said shaft interposed between said shaft and said first-named member, said second plate being secured to the end of said further member adjacent said other end of said first-named member and including a third plate secured to said shaft and the other end of said further member.

7. An x-ray tube according to claim 6 wherein said plates are secured to the associated members and said body by pressed joints.

8. An x-ray tube according to claim 1 wherein said anode body is made of a material having a high thermal emissivity and including a metal annulus forming a target for said electron beam affixed to said one end of said body.

9. An x-ray according to claim 8 wherein said anode body is made of graphite.

* * * * *